US009019109B2

(12) United States Patent
Warmack et al.

(10) Patent No.: US 9,019,109 B2
(45) Date of Patent: Apr. 28, 2015

(54) SMART SMOKE ALARM

(71) Applicant: UT-Battelle, LLC, Oak Ridge, TN (US)

(72) Inventors: Robert J. Bruce Warmack, Oak Ridge, TN (US); Dennis A. Wolf, Oak Ridge, TN (US); Steven Shane Frank, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 14/162,532

(22) Filed: Jan. 23, 2014

(65) Prior Publication Data

US 2014/0203942 A1 Jul. 24, 2014

Related U.S. Application Data

(60) Provisional application No. 61/756,131, filed on Jan. 24, 2013.

(51) Int. Cl.

| | |
|---|---|
| ***G08B 17/00*** | (2006.01) |
| ***G08B 17/10*** | (2006.01) |
| ***G08B 17/117*** | (2006.01) |
| ***G08B 29/22*** | (2006.01) |
| ***G08B 3/10*** | (2006.01) |

(52) U.S. Cl.

CPC ..... *G08B 17/10* (2013.01); *G08B 17/117* (2013.01); *G08B 29/22* (2013.01); *G08B 3/10* (2013.01)

(58) Field of Classification Search

CPC ..... G08B 17/10; G08B 17/117; G08B 29/22
USPC ..... 340/628, 630, 632, 584, 589
See application file for complete search history.

(56) References Cited

U.S. PATENT DOCUMENTS

| | | | | |
|---|---|---|---|---|
| 6,266,428 | B1 * | 7/2001 | Flanigan | 382/100 |
| 7,082,369 | B1 * | 7/2006 | Rubin et al. | 702/19 |
| 8,248,253 | B2 * | 8/2012 | Ankara | 340/584 |
| 2011/0018726 | A1 | 1/2011 | Gonzales | |

OTHER PUBLICATIONS

Cestari et al., "Advanced fire detection algorithms using data from the home smoke detector project," *Fire Safety Journal*, 40:1-28 (2005).
Chen et al., "Development of a Fire Detection System Using FT-IR Spectroscopy and Artificial Neural Networks," *Fire Safety Science*, Sixth International Symposium, International Association for Fire Safety Science (IAFSS), 13 pages (Jul. 1999).
Gottuk et al., "Advanced fire detection using multi-signature alarm algorithms," *Fire Safety Journal*, 37:381-394 (2002).
Rose-Pehrsson et al., "Multi-criteria fire detection systems using a probabilistic neural network," *Sensors and Actuators B*, 69:325-335 (2000).
Warmack et al., "Discriminant Analysis for Home Fire Alarms," PowerPoint Presentation for SUPDET 2012, 19 pages (Mar. 2012).
Warmack et al., "Discriminant Analysis for Home Fire Alarms," Abstract for Presentation for SUPDET 2012, Phoenix, Arizona, 2 pages (Mar. 2012).
Warmack et al., "Home Smoke Alarms, A Technology Roadmap," http://www.ornl.gov/sci/ees/mssed/TechRoadmapRes-SmokeAlarms.pdf, 32 pages (Mar. 2012).
Thomas et al., "Awakening of Sleeping People: A Decade of Research." *Fire Technology* 46(3): 743-61 (2010).

* cited by examiner

*Primary Examiner* — Tai T Nguyen
(74) *Attorney, Agent, or Firm* — Klarquist Sparkman, LLP

(57) ABSTRACT

Methods and apparatus for smoke detection are disclosed. In one embodiment, a smoke detector uses linear discriminant analysis (LDA) to determine whether observed conditions indicate that an alarm is warranted.

23 Claims, 6 Drawing Sheets

SMART SMOKE ALARM

CROSS REFERENCE TO RELATED APPLICATION

This application claims the benefit of U.S. Provisional Application No. 61/756,131, filed on Jan. 24, 2013, which is incorporated herein by reference in its entirety.

ACKNOWLEDGMENT OF GOVERNMENT SUPPORT

This invention was made with government support under Contract No. DE-AC05-00OR22725 awarded by the U.S. Department of Energy. The government has certain rights in the invention.

DETAILED DESCRIPTION

Figure 1:
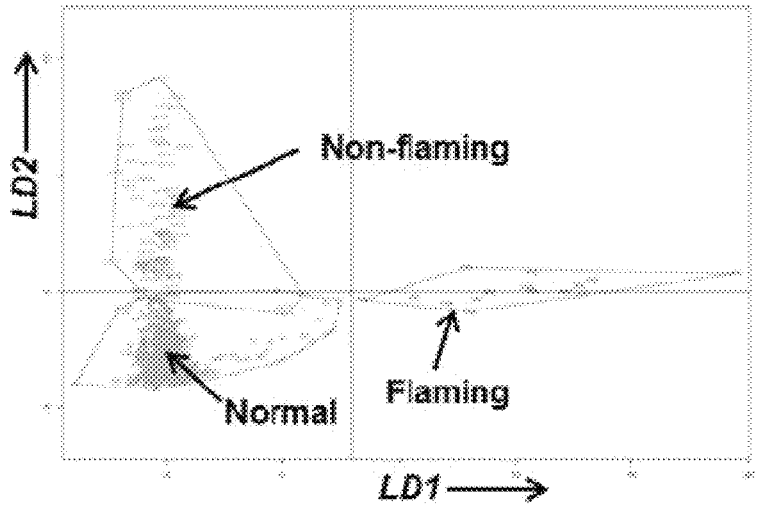
FIG. 1 illustrates an example plot of UL test fire data in linear discriminate coordinates.

The introduction of residential smoke alarms and their widespread adoption over the past four decades has been tremendously successful in saving countless lives and assuring home occupants of their safety in residential fires. Smoke alarms have been developed to be reliable in general, and economical to employ, requiring occasional maintenance of testing and battery replacement. Nevertheless, there remain some shortfalls in operation. Nuisance or false alarms, which are triggered by non-fire related sources, account for the majority of smoke alarm activations. These constitute a serious concern, as occupants sometimes disable the offending alarms, rendering them useless for alarming in genuine fires. Construction methods and room furnishing materials have changed, dramatically increasing the fire growth rate and reducing the time for safe egress. Arousing occupants in a timely manner can be challenging. Given these concerns, improvements in residential smoke alarms could have a huge impact upon residential fire safety, reducing the number of injuries and deaths.

Most residential smoke alarms are based solely upon the detection of smoke aerosol particles emitting from nearly all fires. Ionization and photoelectric aerosol sensors provide sensitivity to various types of smoke aerosols but also, unfortunately, to other aerosols, including cooking fumes, dust and fog. Other principal combustion products, including heat, carbon monoxide, and carbon dioxide, largely have been ignored as means for fire detection.

Fire detection technology must continue to evolve with advances in sensors, microcontrollers, and alerting methods. Indeed, some integration is already beginning to be seen. Combination ionization and photoelectric smoke alarms have been available for a few years.

Approaches for fire alarms based upon rules involving set concentration thresholds of multiple sensors are cumbersome for the design engineer and possibly inaccurate when in service.

SUMMARY

This disclosure concerns the use of advanced statistical techniques that allow data from multiple channels to be classified for alarming. Linear discriminant analysis (LDA), for example, involves a set of linear equations that can be readily evaluated on an inexpensive microcontroller in an advanced smoke alarm. The linear coefficients for the LDA are determined beforehand using training data from fire scenarios.

Fortunately, considerable data already exists in prior tests and can be used for training. Statistical techniques also allow each sensor output and its rate of change to be included in the analysis. A smoke alarm employing one or multiple sensors and a suitably programmed microcontroller can provide faster response to real threats while rejecting conditions that would trigger false alarms in conventional smoke alarms.

Microcontrollers allow even more advanced discrimination techniques to be exploited and are particularly applicable for multiple channels of data which must be classified as "fire," "nuisance," or "normal" conditions. For systems that include a CO sensor, a fourth class could be added to indicate the presence of that toxic gas, according to UL-2034 specifications.

Classification Techniques and Discriminant Analysis

The critical function of a fire alarm is to determine whether observed conditions indicate that an alarm is warranted. For most existing alarms with a single aerosol detector, classification is simply to alarm for aerosol concentrations beyond a fixed threshold. Unfortunately, nuisances can also sometimes trigger the alarm. Designing an alarm based upon whether any one of several channels exceeds a certain threshold can lead to excessive nuisance alarms, if the thresholds are set too low, or insensitivity to fire conditions, if the thresholds are set too high. Pattern recognition or statistical classification couples the data channels, so that the analysis provides the best discrimination for classification based upon sensor response to historic data.

Classification methodologies are types of mathematical techniques that determine class or group membership of an object of unknown membership, according to rules derived from training data collected from all classes. These include discriminant analysis, tree-based modeling, neural networks, and nearest-neighbor classification. Principal components analysis is a useful technique for understanding the main characteristics of multi-attribute data and how those characteristics may relate to class differences. Below, we discuss principal components analysis and then focus upon linear discriminant analysis as a recommended technique to control alarms in residential smoke alarms.

Principal-Components Analysis

One of the goals of principal-components analysis (PCA) is to identify main characteristics of a data set containing a number of interrelated variables (e.g., sensor data channels in a fire alarm) (Joliffe, I. T. *Principal Component Analysis*, Springer-Verlag: New York, 1986). PCA transforms the original variables into a new set of uncorrelated variables called principal components (PCs). The PCs are weighted sums of the original variables, where the weights are optimally chosen. The first PC is constructed so that it explains the most variation in the data, with the caveat that the source of the variation may or may not be due to differences among the classes. The second PC explains the next greatest amount of the variation and is uncorrelated with the first. Similarly other PCs are constructed. PCA is not a classification technique per se, but if the major sources of variation in the data are related to the class differences, then the PCs can be useful in a discriminant analysis. Principal component analysis (PCA) has been used to develop fire-detection algorithms that have shown improved performance for fire sensitivity and nuisance immunity (Cestari, L. A., Worrell, C., Milke, J. A. "Advanced fire detection algorithms using data from the home smoke detector project," *Fire Safety Journal* 40:1-28, 2005).

Linear Discriminant Analysis

Discriminant analysis is supervised pattern recognition (K. V. Mardia, J. T. K.; Bibby, J. M. *Multivariate Analysis*. Academic Press, Inc.: New York, 1976) and can be used for optimal classification of conditions based upon any number of sensor channels. A set of discrimination rules are constructed from training data and used to classify new observations into predefined groups. The basis for pattern recognition is supplied by actual field data of smoke, temperature, and combustion products for stimulating prescribed sets of sensors to be incorporated in a system.

Linear discriminant analysis (LDA) is one approach that classifies an observation according to its (multivariate) similarity or closeness to a group. In LDA, the observed data variables, or their PCs, are transformed by a linear transformation into new, uncorrelated variables, called discriminant coordinates, in such a way to maximize the differences among the predefined groups, as measured on these variables.

Unlike PCA which does not take into account the differences between classes of events, the goal of linear discriminant analysis (LDA) is to separate classes of events. LDA classifies each observation of all sensor channels, including their rates of change, using a simple linear transformation to obtain the discriminant coordinates, i.e., the observation's position in discriminant space. The closeness of the discriminant coordinates to each of the prescribed classes or groups (e.g., "normal," "nuisance," "fire," "toxic," etc.) can then be easily calculated and sorted—even by inexpensive microcontrollers.

There is a hierarchy of the discriminant coordinates. The first discriminant coordinate, $LD_1$, accounts for the greatest separation among the groups; the second discriminant coordinate, $LD_2$, accounts for the next greatest separation, and so forth. The maximum number of discriminant coordinates that can be extracted is one fewer than the number of groups.

Plots of combinations of the various discriminant coordinates are often used to visualize group separations. Clear group separations seen in two-dimensional plots will indicate success for those groups. Groups that appear to overlap in one plot (e.g., in the $LD_1$ vs. $LD_2$ plot), may appear separated in another two-dimensional view (e.g., $LD_2$ vs. $LD_3$). A discrimination rule can still be effective, even though there is no clear separation of groups in certain two-dimensional plots.

To illustrate a specific example, assume that the fire-alarm system consists of three sensors: an ionization chamber, a thermistor, and a CO sensor. Training data from room-sized fires and nuisance sources for these three sensors are used to determine the linear transformation to discriminant coordinates $LD_i$, so that the best separation is made. The data from those sensors might include their scalar values (preprocessed if desired, e.g., averaged and baselined) and their time derivatives for a total of six data channels. Suppose there are four groups of interest: "normal," "nuisance," "CO," and "fire," and we have training data from each group on all six channels. A maximum of three discriminant coordinates can be derived in this example, but suppose for simplicity, that good classification is possible with the first two coordinates. Let $V_i$ represent the six data channels and $a_i$ and $b_i$ represent the corresponding coefficients for the first and second linear discriminants derived from the training set. Suppose $(X_j, Y_j)$ represent the four group centroids calculated from the training data and expressed in linear discriminant coordinates. The coefficients $a_i$ and $b_i$ for transforming the data channels into discriminant coordinates and the centroids $(X_j, Y_j)$ of the four groups are stored in the microcontroller.

During operation of the fire alarm, the three sensors are sampled, the data are preprocessed, and the time derivatives are taken. The preprocessed data channels V, are then converted to discriminant coordinates $(LD_1, LD_2)$ by the linear transform:

$$\sum_i^n a_i V_i = LD_1$$

$$\sum_i^n b_i V_i = LD_2$$

The squared Euclidean distances to each of the centroids are calculated:

$$R_j^2(X_j-LD_1)^2+(Y_j-LD_2)^2$$

The nearest group is then determined from the smallest $R_j^2$. This corresponds to the discriminant classification, which can be used directly for alarm, or further checks and rules can be applied before sounding the alarm. Such an algorithm can be readily employed by inexpensive (<$1) microcontrollers.

LDA Studies Using Fire Test Data

In this study, training data for LDA transformations were supplied by Underwriters Laboratory, Inc. (UL) (Fabian, T. Z. and Gandhi, P. D. 2007. "Smoke Characterization Project." Northbrook, Ill.: Underwriters Laboratory, Inc.) and National Institute of Standards and Technology (NIST) (Bukowski, R. W. et al. "Performance of Home Smoke Alarms." National Institute of Standards and Technology Technical Note 1455-1, February 2008 Revision) and taken from historical tests of fire and nuisance situations in home dwellings. The UL data was recorded by multiple sensors during 18 fire tests in the UL217/UL268 Fire Test Room. The NIST data were recorded during 21 fires each with multiple sensor locations (67 total) in a manufactured and a two-story home plus 25 nuisance tests. The ceiling sensors common to both UL and NIST tests included photoelectric, ionization, temperature, and CO sensors, as well as commercial home smoke alarms.

An LDA was constructed using the UL fire data with events categorized as flaming or non-flaming fires. Data recorded prior to the onset of the fire was categorized as "normal." Only three channels of data were included in the analysis: 1) the baseline corrected ionization signal, 2) its rate of change, and 3) the rate of change of the temperature. A plot of the first two dimensions in LDA space is shown in FIG. 1. The conditions denoting normal, flaming and non-flaming are generally distinctive with little overlap. This indicates that a smart alarm could easily detect hazardous conditions if the LDA coordinates were outside of the "normal" region.

Figure 2A:
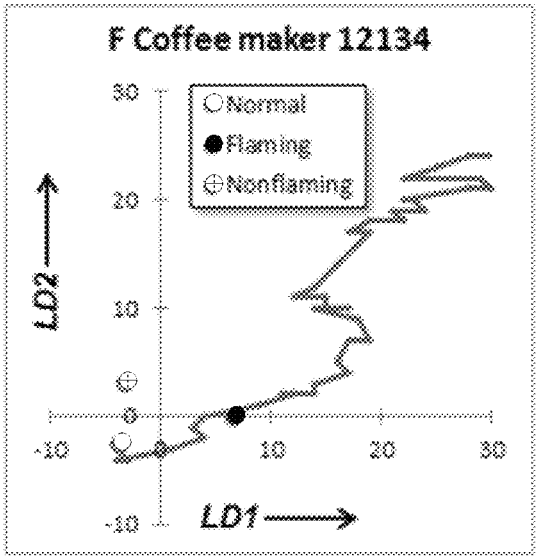
FIGS. 2A-2B illustrate examples of a linear discriminate analysis (LDA) coordinate progression in examples of events to be detected.
Figure 2B:
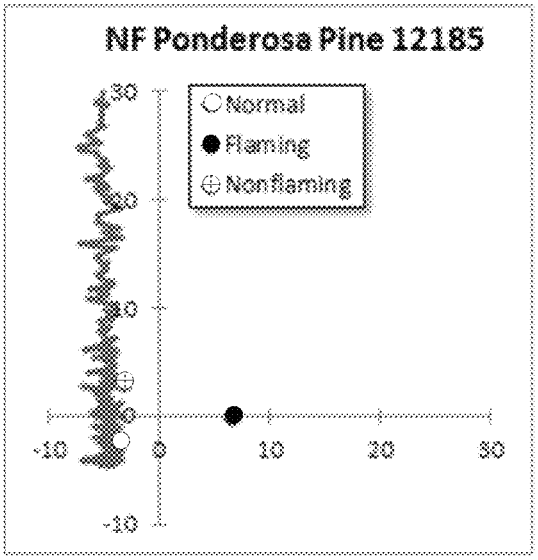

To illustrate the progression of a fire, FIGS. 2A and 2B show the calculated LDA coordinates during two test fires. The coordinates go from normal conditions toward and beyond the centroids expected for flaming and non-flaming fires. Although the LDA coordinates can easily resolve the differences between the two types of fires, only one alarm sound would be produced for typical homeowner use.

Early detection times are also important to extend the time for safe egress in emergency conditions. In the flaming fire test shown in FIG. 2A, the commercial alarms sounded at 3.5 minutes for an ionization alarm and 7.3 minutes for a photoelectric alarm. The alarm based upon LDA coordinate proximity to each of the centroids would have triggered at 2.2 minutes or 37 percent faster than the commercial ionization alarm. In the case of the smoldering fire shown in FIG. 2B, the commercial alarms sounded at 45 minutes and 48 minutes respectively, while the LDA alarm would have alerted at 34 minutes or 24 percent faster.

Figure 3:
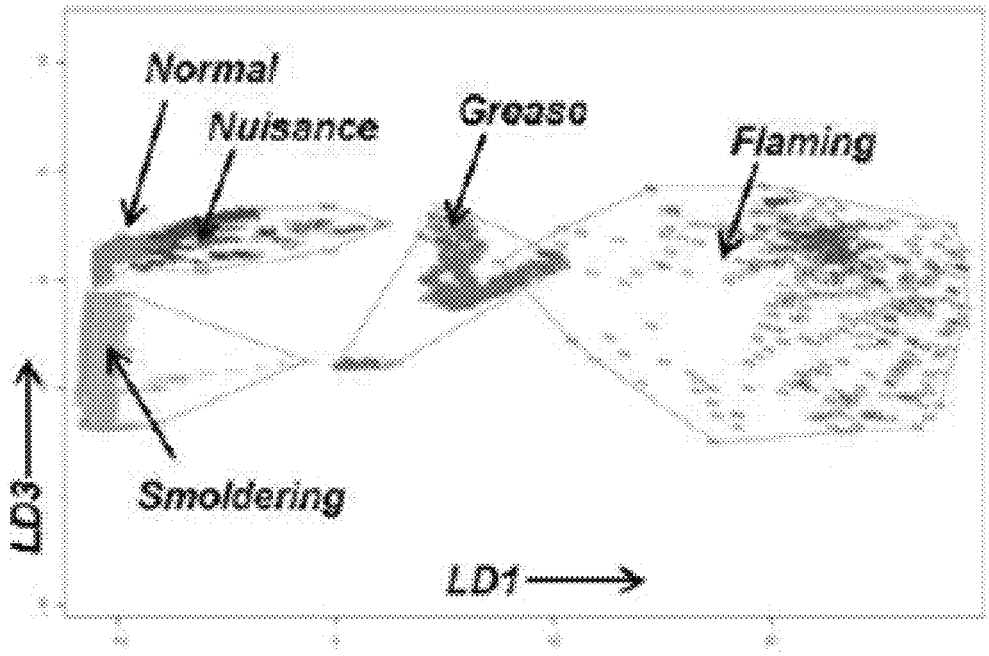
FIG. 3 illustrates an example of NIST fire and nuisance data categorized and plotted in two dimensions of linear discriminate space.

The NIST data includes a variety of fires and nuisance sources, so that response time and false-alarm rejection can be evaluated for various LDAs. Because the characteristics of the fires change during their evolution, groups were more narrowly defined according to sensor response. For example, data were considered as "Flaming" when the rates of increase in temperature and ionization signal were above set thresholds. Conversely, data were considered as "Smoldering" when the rates of increase in temperature and ionization signal were below set thresholds. Other signals can be considered as well in this group categorization. An example is shown in FIG. 3.

The performance of various LDA-based alarms was compared to the commercial alarms used in the NIST tests. Using four sensors, ionization, photoelectric, temperature and carbon monoxide, an LDA alarm would have alerted to the smoldering fires an average of more than 18 minutes faster than a conventional photoelectric-ionization combination alarm. Such an LDA alarm was also found to trigger more slowly than conventional smoke alarms and fully suppress half of the nuisances that triggered false alarms in conventional smoke alarms. In another example using only photoelectric and temperature sensors an LDA alarm would have alerted to the smoldering fires an average of more than 23 minutes faster than a conventional photoelectric-ionization combination alarm and generally responded more slowly to nuisances but fully rejected about 1 in 5 nuisance sources. Even when a conventional photoelectric sensor was only used, LDA processing was shown to have improved the alerting to smoldering fires by an average of 20 minutes compared to a conventional photoelectric alarm, although there was only a small improvement in false-alarm rejection.

The conclusion is that LDA processing alone can improve response time, at least for smoldering fires, while adding addition sensors can provide rejection of nuisance sources for false alarms. The addition of carbon monoxide is two-fold: 1) acting as a toxic-gas sensor and 2) acting in concert with smoke sensors for fire detection. A practical smoke alarm is described next that combines commercial sensors with a microcontroller implementation of LDA processing.

Prototype Design & Construction

A prototype home smoke alarm was constructed using multiple sensors integrated by an inexpensive microcontroller. The circuit allows up to four sensors to be populated and used for discrimination, including ionization, photoelectric, carbon monoxide (CO), and temperature sensors. Baseline subtraction and rate of change were implemented along with a simple set of threshold alarms. A low-frequency speaker was added for improved alerting. The assembled prototype included components mounted on a custom printed-circuit board and enclosed in a custom shell, fabricated using a three-dimensional plastic printer. The prototype serves to demonstrate a practical multiple-sensor smoke alarm that also allows expansion using more advanced discrimination algorithms.

Sensor Selection

Based upon the results of literature reviews and experimental testing of individual candidate sensor technologies, a set of sensors was selected for incorporation into the prototype. Five types of sensors were considered: aerosol (photoelectric and ionization); temperature; carbon monoxide, carbon dioxide and Taguchi. Over the past four decades, aerosol sensors have proven to be very effective for fire detection. Photoelectric-type aerosol alarms are effective with larger-particle aerosols often associated with smoldering fires, while ionization-type aerosol alarms are sensitive to small-particle aerosols produced in flaming fires. Since these two sensor types tend to be complementary, both were included in the prototype.

Temperature sensors are desirable to monitor heat produced especially with fast-growing fires, and they are nuisance-alarm-resistant. A simple thermistor was chosen, because it is inexpensive, can respond rapidly, and requires minimal power.

Carbon monoxide is associated with nearly all fires, but it is generally not associated with typical nuisance sources that often cause false alarms. Gottuk and coworkers demonstrated that combination aerosol and CO detectors using simple algorithms significantly improve fire detection and false-alarm rejection (Gottuk, D. T. et al. (2002) "Advanced fire detection using multi-signature alarm algorithms." *Fire Safety Journal* 37:381-94). Cestari and coworkers also found that CO sensing alarms could respond to smoldering fires faster than photoelectric-type aerosol sensors and with better nuisance rejection (Cestari, L. A., C. Worrell, and J. A. Milke (2005) "Advanced fire detection algorithms using data from the home smoke detector project." *Fire Safety Journal* 40(1): 1-28). Manufacturers have developed practical electrochemical CO sensors for toxic-gas monitors and are beginning to incorporate them into home smoke alarms. These CO sensors respond discriminately, use very little power, and can last 7 years or more. Tests at ORNL showed that these sensors have sensitivity levels of less than 1 part per million (ppm) CO and rise times of roughly 20-30 seconds, which is consistent with early fire detection needs.

Carbon dioxide ($CO_2$) sensing is very desirable, but unfortunately, current $CO_2$ sensors consume too much power. Existing commercial designs, either infrared or electrochemical, consume 1-3 watts, greatly exceeding the maximum of roughly 0.5 mW available continuously from a 9V battery for 1 year. Furthermore, this power consumption also is too high for a 7-day battery backup of a wired system.

Taguchi, or heated metal-oxide sensors, were also considered because of their sensitivity to combustion-related effluents. Tests at ORNL showed that they could detect sub-ppm changes in CO, hydrocarbons, formaldehyde, HCN, HCl, acrolein, and other compounds. Unfortunately, Taguchi sensors are also sensitive to humidity changes and to interferents like cigarette smoke and other household products, which limit effective levels of detection. Their properties can also change over time, and their responsivity can diminish following exposure to silicones and hair grooming products, according to the manufacturer. Additionally, the power required for operation of ordinary Taguchi sensors is too high, but microfabricated versions might be operated at levels as low as 1 mW average power, approaching that available for battery operation. Due to questions about acceptance by the fire detection community, uncertainty about lifetime and calibration, and their lack of specificity for smoke combustion products, Taguchi sensors were not chosen for implementation in the prototype.

Prototype Design

I. Microcontroller

Figure 4:
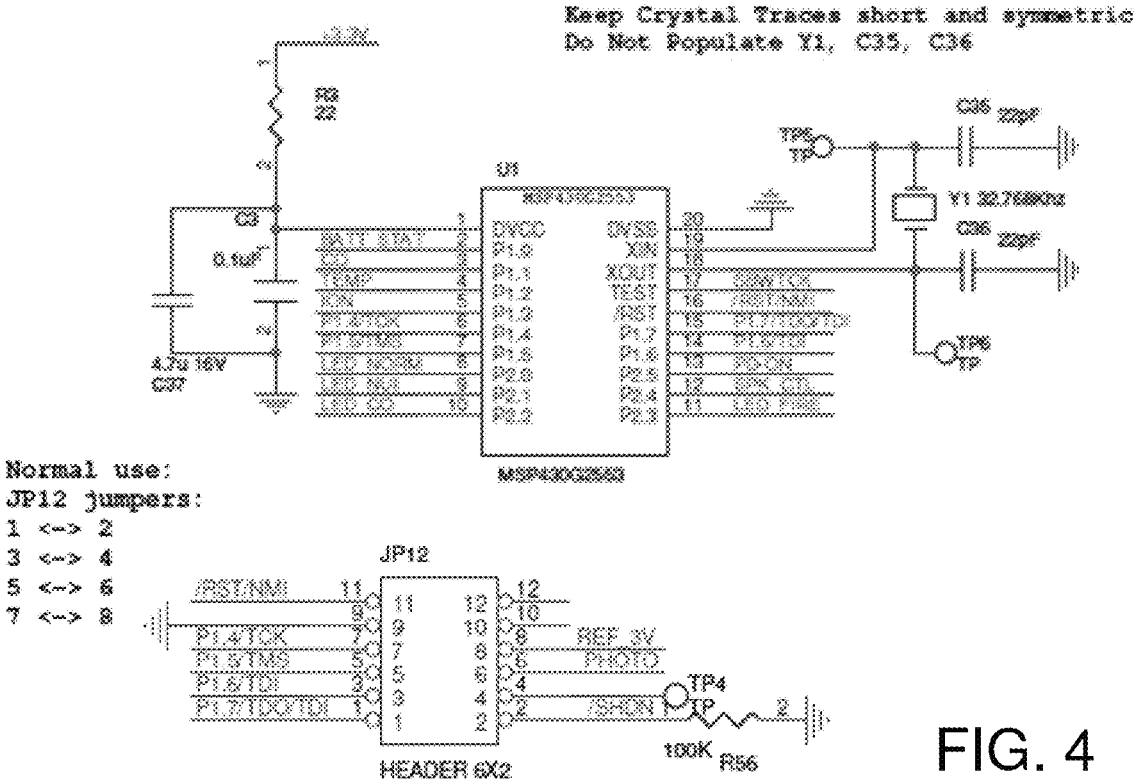
FIG. 4 illustrates a schematic of a representative microcontroller and its connections to the sensors in FIGS. 5-8.

To promote acceptance by manufacturers, ORNL designed a demonstration prototype smoke alarm using components and methods that have been well proven for use in residential smoke alarms. In fact, the sensors were selected from manufactured smoke alarms. However, analog output signals were generated rather than using application-specific integrated circuits (ASICs) that are frequently used for aerosol sensors. This allowed all signals to be handled by a central microcontroller that is used also for power management and alarm generation. The microcontroller and overall design also allow extension to an advanced version using mathematical discrimination algorithms. FIG. 4 illustrates a schematic of a representative microcontroller and its connections to the sensors in FIGS. 5-8.

II. Sensors

Figure 5:
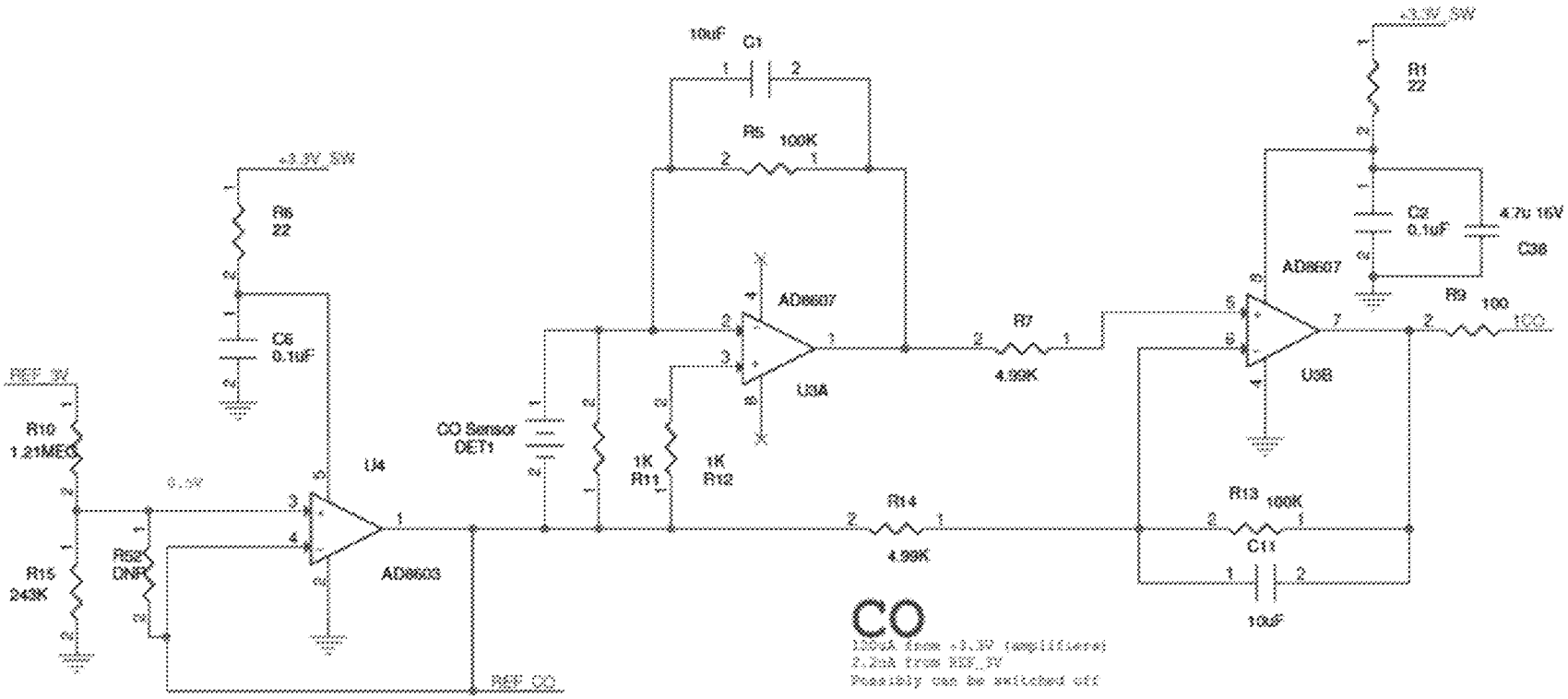
FIG. 5 illustrates a schematic of a representative sensor, specifically a carbon monoxide sensor.
Figure 6:
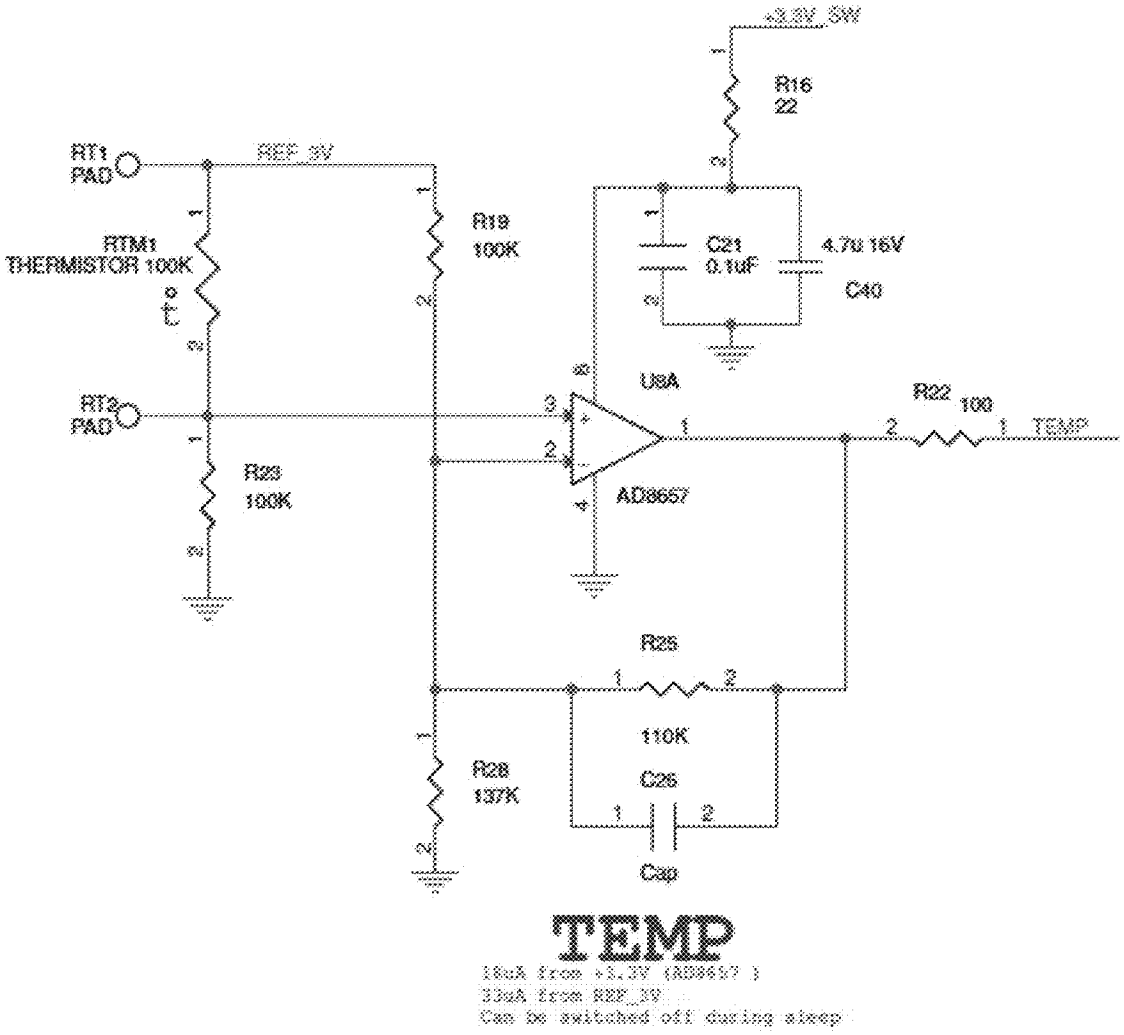
FIG. 6 illustrates a schematic of a representative sensor, specifically a temperature sensor.
Figure 7:
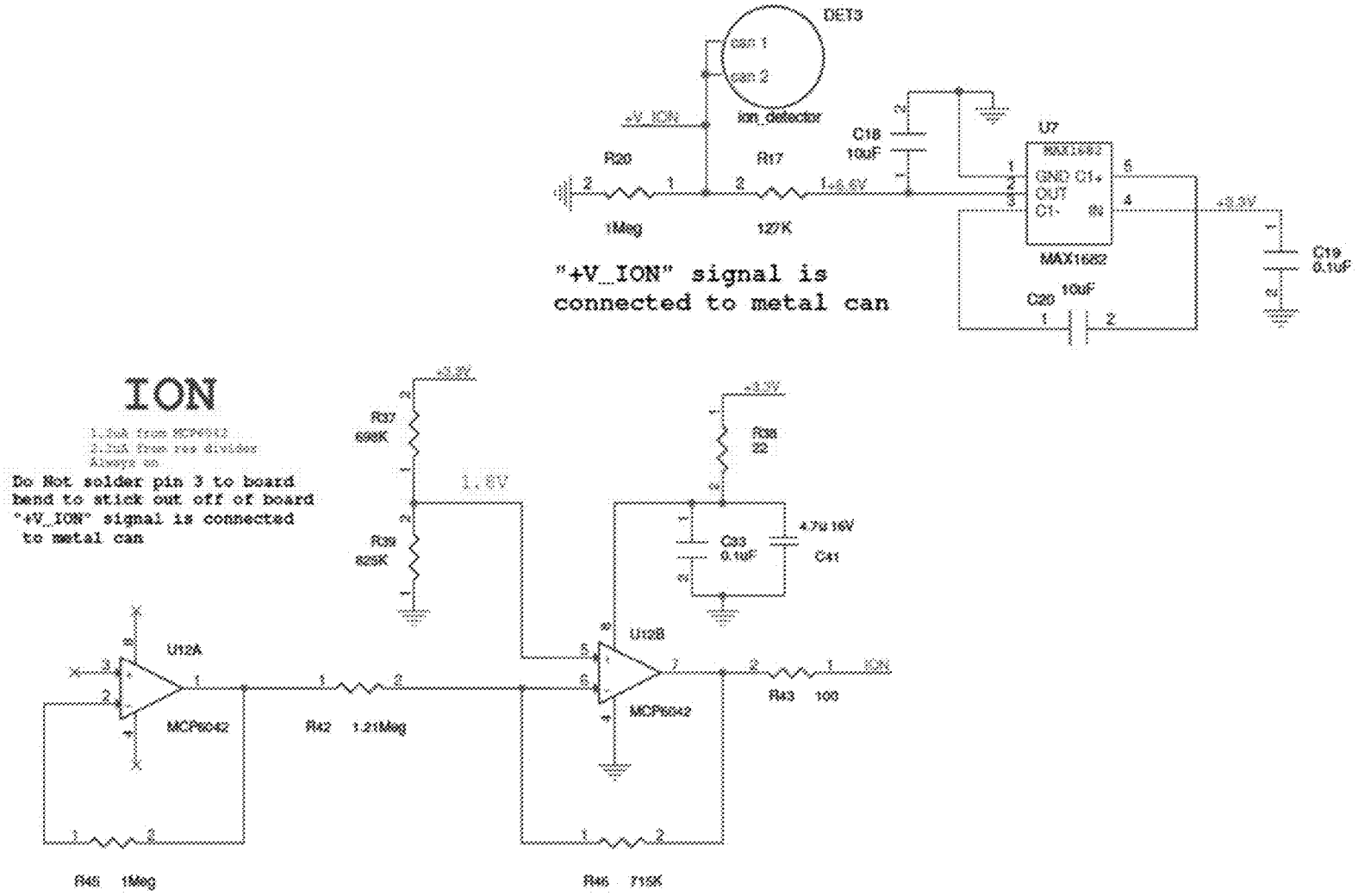
FIG. 7 illustrates a schematic of a representative sensor, specifically an ionization aerosol sensor.
Figure 8:
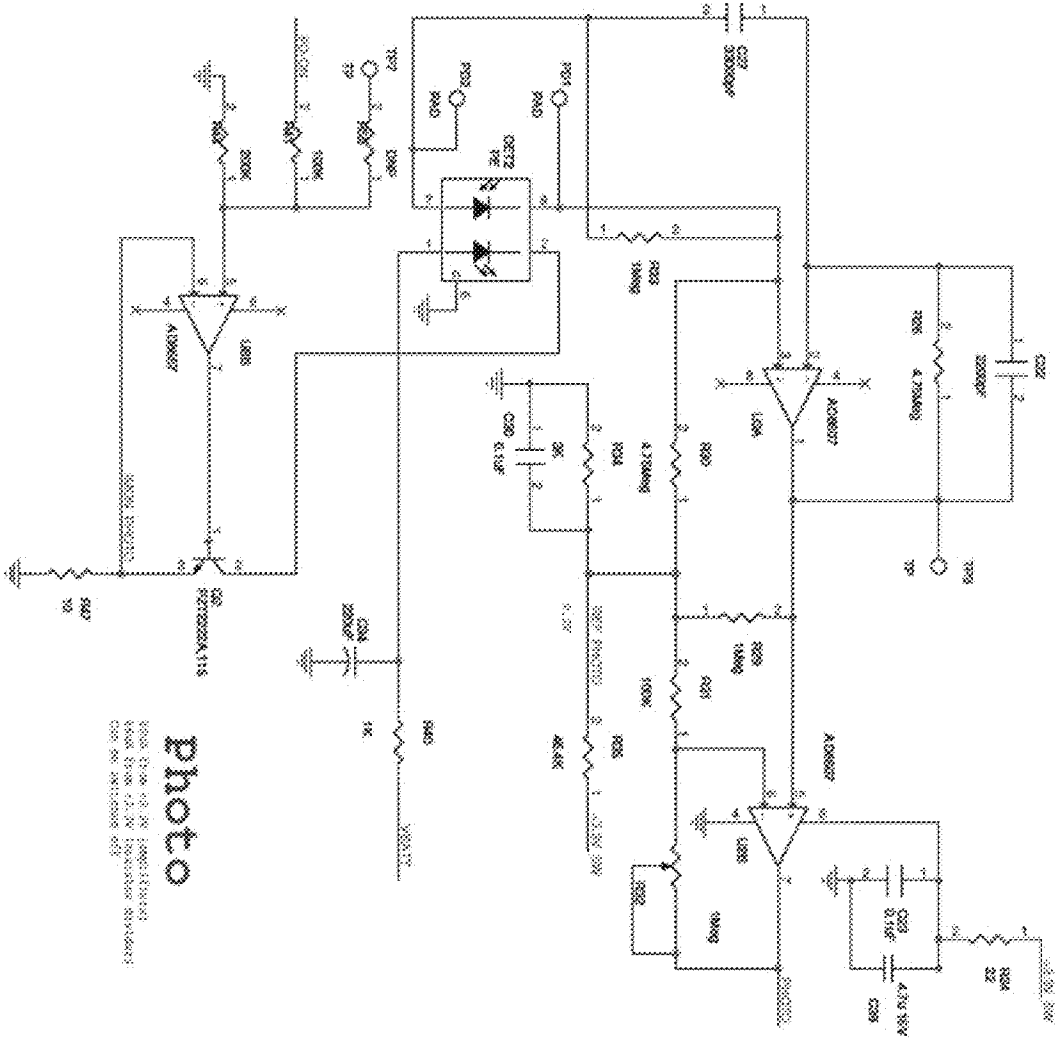
FIG. 8 illustrates a schematic of a representative sensor, specifically a photoelectric aerosol sensor.

FIGS. 5-8 illustrate schematics of representative sensors. Specifically, FIG. 5 illustrates a schematic of a carbon monoxide sensor; FIG. 6 illustrates a schematic of a temperature sensor; FIG. 7 illustrates a schematic of an ionization aerosol sensor; and FIG. 8 illustrates a schematic of a photoelectric aerosol sensor. The ionization-type aerosol sensor operates by using a high-impedance amplifier to monitor the voltage on an internal plate that changes when excess charge accumulates due to aerosol particles inside the sensor. A voltage-doubling integrated circuit is used to bias the outer shell of the ion sensor to +6.6V. The photoelectric-type aerosol sensor monitors the scattered light from aerosol particles illuminated by an infrared light-emitting diode (LED). The LED is pulsed by the microcontroller, which waits about 300 μs to allow settling before reading the scattered-light photodiode. The CO sensor produces current (about 2.4 nA/ppm) that is converted by a high-impedance amplifier to a voltage, offset by 0.5V. The thermistor is connected to a simple amplifier circuit designed to correct for nonlinearity.

III. Electronics

The electronics are powered by three AA batteries regulated to 3.3V plus a 3.0V reference voltage for the analog-to-digital converter (ADC). Power is conserved between reading cycles by having the microcontroller switch off the 3.3V regulator that supplies power to all amplifiers, except for the ionization circuit, which consumes negligible power. The microcontroller is then set into a sleep mode for 3-10 seconds, after which power is reapplied to all circuits for another reading cycle.

IV. Speaker

A speaker is used to sound lower-frequency alarms deemed to improve alerting. Studies of various groups of subjects, including children and the elderly, tested for their ability to hear various alarm signals, have shown that voice alarms and a lower-pitch signal prompted better alerting than high-pitched sounds (Ahrens, M. (2008). "Home Smoke Alarms The Data as Context for Decision." *Fire Technology* 44: 313-27). In particular, Thomas and Bruck have found that a 520-Hz square-wave auditory signal is much more effective than the currently used 3100-Hz T-3 alarm signal (Thomas, I. and D. Bruck. "Awakening of Sleeping People: A Decade of Research." *Fire Technology* 46(3): 743-61). The widely spaced overtones produced by the square-wave excitation of the voice-coil speakers appear to be important in the alerting action. In the prototype, the battery is directly connected to the 8-ohm speaker through a switching transistor. If a fire alarm is warranted, the microcontroller switches the transistor at a 520-Hz frequency in a T-3 cycle. If a CO toxic alarm is warranted, a T-4 cycle would be used, as is required by UL2034.

LDA Implementation

Raw data from m sensors are preprocessed to give signal above baseline and the rate of change. First, the baselines are calculated using a moving average of n or n' previous measurements, where i ranges from 1 to the number of sensors and $V_i$ is the ADC reading from each of the sensors.

$$B_i|_{new}=[(n-1)B_i+V_i]/n$$

$$B_i'|_{new}=[(n'-1)B_i'+V_i]/n' \quad (1)$$

Generally, n is large to account for slow changes in sensor baseline, perhaps caused by environmental drift in temperature, humidity, or aerosols, for example. Changes over a shorter time may be due to changing conditions due to fires, so another baseline $B_i'$ over, say, 5-10 minutes may be appropriate. Either or both baseline averages can be utilized. If the smoke alarm samples every 3 seconds, for example, setting $n=2^{13}$ would correspond to a moving baseline average over about 6.8 hours, while $n=2^7$ would correspond to a moving baseline average over about 6.4 minutes.

Signals for linear discrimination are then calculated based upon these revised baselines and the mean of the group means, C, determined beforehand by LDA.

$$S_i=V_i-B_i-C_i$$

$$S_i'=V_i-B_i'-C_i' \quad (2)$$

As an example, the set of signals for the prototype consists of the 1) temperature referenced against a baseline over 6.4 minutes, 2) ionization voltage referenced against a baseline over 12.8 minutes, 3) ionization output voltage referenced against a baseline over 6.8 hours, 4) photoelectric output voltage referenced against a baseline over 6.8 hours, and 5) carbon monoxide level referenced against a baseline over 27 hours. Signals and baselines are chosen based upon the sensors available and their responses characteristic of fires and nuisances that are included in the test data.

The LD coordinates are then calculated based upon transformation coefficients determined beforehand by LDA. The number of LD coordinates $LD_j$ can range from one to the number of signal channels, $S_i$ plus $S_i'$. Typically, a two dimensional LD space is adequate for distinguishing among the various groups.

$$LD_j = \sum_{i=1}^{m} (D_{ij}S_i + D'_{ij}S'_i) \quad (3)$$

Classification into one of l groups can then be determined by evaluating the relative Cartesian distance squared $R_k^2$ to each of the group means or centroids, $G_{kj}$, where k=1 to l. The minimum $R_k^2$ determines the group identification.

$$R_k^2 = \sum_j (G_{kj} - LD_j)^2 \quad (4)$$

Each of the steps, represented by Equations (1) to (4), can be readily handled in real time by modern microcontrollers.

The mathematics an even be performed using integer arithmetic simply by appropriate scaling with powers of two utilizing register shifts. For baseline calculations, we store the baseline multiplied by $2^n$, (i.e., store $2^nB_i$) and update the baseline using the ADC value of the signal $$2^nB_i|_{new} = 2^nB_i - \frac{2^nB_i}{2^n} + V_i \tag{5}$$

$$B_i|_{new} = 2^nB_i|_{new}/2^n$$

Division by $2^n$ is readily accomplished by a microcontroller register shift of n places to the right. The time interval over which the baseline is calculated in $2^n$ times the reading interval. For example, if the reading interval is 10 seconds, setting n=11 corresponds to a moving average over approximately 8 hours. Typically, a 32-bit integer is necessary to store $2^nB_i$.

Integer computation of the signals in (2) is straightforward. Computation of the discriminant coordinates requires that fractional coefficients $D_{ij}$ of (3) be multiplied by a large constant, say $2^{12}$, which can be statically stored by the microcontroller. Equation (3) then becomes $$LD_j = \left[\sum_i^m ((2^{12}D_{ij})S_i + (2^{12}D'_{ij})S'_i)\right] \Big/ 2^{12} \tag{6}$$

Integer multiplication, addition and register shifts are required. Similarly, (4) is calculated by integer subtraction and multiplication.

One example of a method of detecting a condition comprises the steps of:

a. providing one or more sensors for observing a condition and producing a data signal that is indicative of the present condition;

b. subjecting the one or more sensors to one or more different known conditions and capturing a series of data signals that are responsive to the different known conditions;

c. processing the data signals and determining the coefficients $a_i$ and $b_i$ for transforming the data signals into discriminant coordinates and the centroids $(X_j, Y_j)$;

d. storing the coefficients $a_i$ and $b_i$ and the centroids $(X_j, Y_j)$ in a memory device;

e. sampling the one or more sensors in response to the current condition and then calculating the time derivatives of the data signal;

f. converting the data signal to discriminate coordinates $(LD_1, LD_2)$;

g. calculating the squared Euclidean distances from the discriminate coordinates $(LD_1, LD_2)$ to each of the centroids $(X_j, Y_j)$; and h. determining the smallest squared Euclidean distance and assigning the data signal a discriminant classification.

The method may further comprise the step of: i) producing an audible alert if the discriminant classification determined in step h) is indicative of a dangerous condition. The one or more sensors may comprise an ionization sensor, a photoelectronic sensor, a carbon monoxide sensor, and a temperature sensor.

An example of an apparatus for detecting an event comprises:

one or more sensors for observing a condition and producing a data signal that is indicative of the present condition;

a microprocessor having a memory device and a processor, said microprocessor for subjecting the one or more sensors to one or more different known conditions and observing a series of data points, processing the data points and determining the coefficients $a_i$ and $b_i$ for transforming the data points into discriminant coordinates and the centroids $(X_j, Y_j)$, storing the coefficients $a_i$ and $b_i$ and the centroids $(X_j, Y_j)$ in a memory device, sampling the one or more sensors and then calculating the time derivatives of the data point, converting the data point to discriminate coordinates $(LD_1, LD_2)$, calculating the squared Euclidean distances from the discriminate coordinates $(LD_1, LD_2)$ to each of the centroids (Xj, Yj), and determining the smallest squared Euclidean distance and assigning the data point a discriminant classification.

We claim as our invention all that comes within the scope and spirit of these claims.

What is claimed is:

1. A smoke detector comprising:

one or more sensors for sensing combustion products, said one or more sensors including an aerosol sensor, said one or more sensors each having a sensor data output;

a microcontroller connected to said one or more sensor data outputs, the microcontroller configured to determine, using linear discriminant analysis, whether data from the sensor data outputs are categorized as fire indicating data, and to produce a fire indicating signal if the data from the sensor data outputs are categorized as fire indicating data, wherein the microcontroller is configured to store centroids for fire indicating data and for non-fire indicating data, the microcontroller being configured to compute discriminant coordinates for data from the one or more data sensors based upon linear discriminant analysis and to produce the fire indicating signal in an event the computed discriminant coordinates are nearer to a stored fire indicating centroid than a stored non-fire indicating centroid; and an alarm connected to the microcontroller that is operable to produce an audible alert in response to a fire indicating signal from the microcontroller.

2. A smoke detector according to claim 1 wherein there are plural stored fire indicating centroids, said plural stored fire indicating centroids including a first stored centroid for a flaming fire, a second stored centroid for a grease fire, and a third stored centroid for a smoldering fire; and wherein there are plural stored non-fire indicating centroids, said plural stored non-fire indicating centroids including a first stored centroid for normal data and a second stored centroid for nuisance data.

3. A smoke detector according to claim 1 wherein the one or more sensors comprise an ionization aerosol sensor, a photoelectric aerosol sensor, a temperature sensor, and a carbon monoxide sensor.

4. A smoke detector according to claim 1 wherein the microcontroller is configured to determine a rate of change of data from the sensor data output from the aerosol sensor, wherein the microcontroller determines, using linear discriminant analysis, whether data from the aerosol sensor and the rate of change of data from the sensor data output from the aerosol sensor are categorized as fire indicating data.

5. A smoke detector according to claim 1 wherein there are M sensors, the microcontroller being configured to compute one or more moving baseline averages for each sensor using a moving average of at least one of n or n' previous measurements from the sensor in accordance with the following formulas, in which i ranges from 1 to the number of sensors for which a baseline moving average is computed and Vi is the analog digital converted (ADC) value of the sensor data output from each of the sensors for which a baseline moving average is computed:

$$B_i|_{new} = [(n-1)B_i + V_i]/n$$

$$B_i'|_{new} = [(n'-1)B_i' + V_i]/n'$$

and wherein n is different from n' so as to correspond to a different moving baseline average, the microcontroller being configured to calculate signals $S_i$ and $S_i'$ for linear discriminant analysis based upon the moving baseline averages and means of group means, $C_i$, using the following formulas:

$$S_i=V_i-B_i-C_i$$

$$S_i'=V_i-B_i'-C_i' \quad (2)$$

the microcontroller further being configured to calculate linear discriminant (LD) coordinates for the sensor output data from the M sensors based upon transformation coordinates determined from sensor data for known conditions, and wherein the microcontroller is configured to categorize the LD coordinates into plural groups including a fire indicating data category using the formula below by evaluating the Cartesian distance squared, $R_k^2$, to the centroids, $G_{kj}$, of each category of data, wherein in the formula below j indicates the number of LD coordinates, wherein k=1 to l, the number of categories, and wherein the minimum R determines the group categorization, and wherein:

$$R_k^2=\Sigma_j(G_{kj}-\mathrm{LD}_j)^2.$$

6. A smoke detector according to claim 5 wherein n' corresponds to a moving average over 5 to 10 minutes.

7. A smoke detector according to claim 5 wherein n and n' are different for a plurality of different sensors.

8. A smoke detector according to claim 5 wherein the M sensors include an ionization aerosol sensor, a photoelectric aerosol sensor, and a temperature sensor.

9. A smoke detector according to claim 8 wherein the M sensors include a carbon monoxide sensor.

10. A smoke detector according to claim 1 wherein the microcontroller excites the alarm with a square wave in the auditory hearing range in response to a fire indicating signal from the microcontroller.

11. A smoke detector according to claim 1 wherein there are M sensors, the microcontroller being configured to compute a moving baseline averages for each sensor using a moving average of n previous measurements from the sensor in accordance with the following formula, in which i ranges from 1 to the number of sensors for which a baseline moving average is computed and Vi is the analog digital converted (ADC) value of the sensor data output from each of the sensors for which a baseline moving average is computed:

$$2^n B_i\,|_{new} = 2^n B_i - \frac{2^n B_i}{2^n} + V_i$$

and wherein the microcontroller is configured to calculate signal, $S_i$, for linear discriminant analysis based upon the moving baseline average and means of group means, $C_i$, using the following formula:

$$S_i=V_i-B_i-C_i$$

the microcontroller further being configured to calculate linear discriminant (LD) coordinates for the sensor output data from the M sensors based upon transformation coordinates determined from sensor data for known conditions, and wherein the microcontroller is configured to categorize the LD coordinates into plural groups including a fire indicating data category using the formula below by evaluating the Cartesian distance squared, $R_k^2$, to the centroids, $G_{kj}$ of each category of data, wherein in the formula below j indicates the number of LD coordinates, wherein k=1 to l, the number of categories, and wherein the minimum $R_k^2$ determines the group categorization, and wherein:

$$R_k^2=\Sigma_j(G_{kj}-\mathrm{LD}_j)^2.$$

12. A smoke detector, comprising:

an aerosol sensor configured to generate aerosol sensor data;

a microcontroller operatively connected to the aerosol sensor, the microcontroller configured to:

determine a rate of change of aerosol sensor data;

map the aerosol sensor data and the rate of change of aerosol sensor data into linear discriminant space using transformation coefficients based on linear discriminant analysis (LDA) training data;

from plural centroids, determine a nearest centroid to the aerosol sensor data and the rate of change of aerosol sensor data in linear discriminant space, each centroid corresponding to a different known condition and based on LDA training data; and to provide an alarm signal if the nearest centroid corresponds to a hazardous condition; and an alarm operatively connected to the microcontroller, the alarm producing an audible alert in response to the alarm signal.

13. A smoke detector according to claim 12 wherein said plural centroids include a first centroid corresponding to a flaming fire, a second centroid corresponding to a non-flaming fire, a third centroid corresponding to normal data, and a fourth centroid corresponding to nuisance data.

14. A smoke detector according to claim 12 further comprising a carbon monoxide sensor operatively connected to the microcontroller.

15. A method of detecting a hazardous condition, comprising:

receiving data from a plurality of data channels, the data being indicative of a plurality of environmental conditions;

transforming the data from the plurality of data channels, using a microcontroller, into linear discriminant space;

determining a distance, using a microcontroller, from the data from the plurality of data channels in linear discriminant space to each of a plurality of centroids, each centroid indicating a different category of environmental conditions including a fire indicating category and a non-fire indicating category, the categories being determined based on linear discriminant analysis of data from known environmental conditions;

classifying, using a microcontroller, the data indicative of the plurality of environmental conditions into a category corresponding to a centroid having the nearest distance from data from the plurality of data channels in linear discriminant space; and providing an audible alarm if the category having a centroid with the nearest distance is in a fire indicating category.

16. The method of claim 15 further comprising:

detecting a plurality of environmental conditions to generate the data for the plurality of data channels; and processing the data from the plurality of data channels to account for baseline environmental conditions to provide data from the plurality of data channels for the transforming step.

17. The method of claim 16 wherein processing the data from the plurality of data channels to account for baseline environmental conditions includes:

calculating a first moving average of n previous measurements from a sensor;

subtracting the first moving average from a current measurement from the sensor;

calculating a second moving average of n' previous measurements from the sensor, n and n' being different; and subtracting the second moving average from the current measurement from the sensor.

18. The method of claim 16 wherein the audible alarm is provided by a speaker excited by a square wave.

19. The method of claim 16 wherein the plurality of environmental conditions are detected by a temperature sensor, an aerosol sensor, a carbon monoxide sensor, a carbon dioxide sensor, a Taguchi sensor, or combinations thereof.

20. The method of claim 16 wherein the data indicative of the plurality of environmental conditions is classified into a category corresponding to normal conditions, flaming conditions, or non-flaming conditions.

21. A method of detecting a hazardous condition, comprising:

providing one or more sensors for observing environmental conditions;

producing a plurality of signals indicative of the environmental conditions;

using a microcontroller to perform a linear transform to map the plurality of signals into linear discriminant space;

using a microcontroller to determine a distance from the plurality of signals in linear discriminant space to each centroid of a plurality of centroids, each centroid indicating a different category of environmental conditions;

using a microcontroller to classify the environmental conditions as belonging to the category corresponding to the centroid nearest to the plurality of signals in linear discriminant space; and producing an alert if the environmental conditions are classified as belonging to a category corresponding to a hazardous condition.

22. The method of claim 21 wherein the one or more sensors include a temperature sensor, an aerosol sensor, a carbon monoxide sensor, a carbon dioxide sensor, a Taguchi sensor, or combinations thereof.

23. The method of claim 21 wherein producing a plurality of signals indicative of the environmental conditions includes:

taking a current measurement from the one or more sensors;

calculating a first moving average of n previous measurements from the one or more sensors;

subtracting the first moving average from the current measurement from the one or more sensors;

calculating a second moving average of n' previous measurements from the one or more sensors, n and n' being different; and subtracting the second moving average from the current measurement from the one or more sensors.

* * * * *